US006954964B2

(12) United States Patent
Parkkonen

(10) Patent No.: US 6,954,964 B2
(45) Date of Patent: Oct. 18, 2005

(54) PAINT BRUSH SCRUBBER

(76) Inventor: Miles Milton Parkkonen, 608 Baldwin Ave., Negaunee, MI (US) 49866

( * ) Notice: Subject to any disclaimer, the term of this patent is extended or adjusted under 35 U.S.C. 154(b) by 70 days.

(21) Appl. No.: 10/753,662

(22) Filed: Jan. 9, 2004

(65) Prior Publication Data

US 2005/0150068 A1 Jul. 14, 2005

(51) Int. Cl.[7] ..... A46B 17/06; B44D 3/00

(52) U.S. Cl. ..... 15/105; 15/236.03; 15/236.08; 15/236.07; 15/104.001; D8/14

(58) Field of Search ..... 15/105, 236.03, 15/141.1, 142, 104.001, 236.06, 236.07, 15/236.08, 239.09, 236.01; D8/14; 7/105, 7/165; D32/67; 68/223, 226, 227, 228; 69/228, 69/229

(56) References Cited

U.S. PATENT DOCUMENTS

| | | | | | |
|---|---|---|---|---|---|
| D122,834 | S | * | 10/1940 | Bloom | D32/67 |
| 2,504,819 | A | * | 4/1950 | Flores | 68/224 |
| 2,524,475 | A | * | 10/1950 | Renz | 416/71 |
| 2,860,858 | A | * | 11/1958 | Kurs | 366/129 |
| 4,324,018 | A | * | 4/1982 | Olsson | 15/236.03 |
| 4,350,445 | A | * | 9/1982 | Olsson | 366/343 |
| 4,982,471 | A | * | 1/1991 | Bannan | 15/105 |
| 5,546,625 | A | * | 8/1996 | Mealey, Sr. | 15/105 |
| 5,694,660 | A | * | 12/1997 | Rachwalski | 15/237 |
| D457,793 | S | * | 5/2002 | D'Astous | D8/19 |
| 6,421,860 | B1 | * | 7/2002 | Abbott | 7/105 |
| 6,427,274 | B1 | * | 8/2002 | Abbott | 7/105 |

FOREIGN PATENT DOCUMENTS

| | | | |
|---|---|---|---|
| GB | 2270464 | * | 3/1994 |
| GB | 2392082 | * | 2/2004 |
| WO | 98/49019 | * | 11/1998 |

* cited by examiner

*Primary Examiner*—Gary K. Graham

(57) ABSTRACT

The Paint Brush Scrubber is a two sided device, for left and right handed use. It has a multiple notched scrub board on each side and a semicircular cutout on one edge. It cleans regulator and sponge paint brushes, paint rollers, and paint pad applicators. Can also be used to clean other types of brushes and other things including clothes etc. The size of the scrubber can vary from a size for an artist brush to the size of a house painters 4" brush. It has a hole in handle so it can be stored with your paint brushes. It is safe to use and will never require parts or service. Paint brushes are cleaned by scrubbing action, which separates the bristles, cleaning quickly and easily, without getting your hands dirty. As the brush being cleaned it cleans the scrubber, so when the brush is clean the scrubber is also clean. The bristles are combed back into shape after cleaning using the cutout and scrub board. The scrubber also cleans paint rollers by scraping off most of paint into the paint container, using the semicircular cutout area of the scrubber, than scrubbing off the rest using the scrub board. Paint pad applicators are also cleaned using the scrub board.

1 Claim, 1 Drawing Sheet

PAINT BRUSH SCRUBBER

BACKGROUND OF THE INVENTION

1. Field of the Invention

Figure 1:
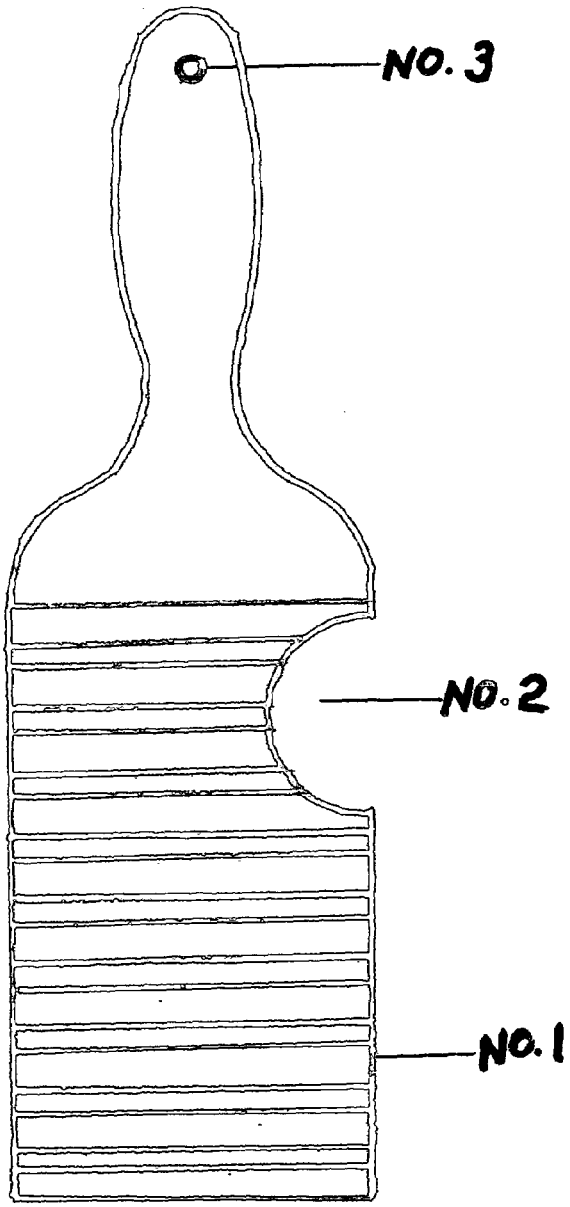

This invention relates to a device for cleaning painting equipment and in particular a device for cleaning paint brushes, paint rollers and paint pad applicators.

2. Prior Art

This invention relates in general to the problem of cleaning regular and sponge type paint brushes, paint rollers and pad applicators. It is very difficult to flush the paint out of the above equipment by shaking in a container of water or solvent or holding them under running water. There is a large amount of paint in the bristles of the brushes and the nap of the rollers and pads, making them difficult to clean properly. There is a tendency to buy cheap brushes, rollers and pads and throw them away after each use because of the difficulties in cleaning them. A good paint job requires good paint brushes, rollers and pads. They should not be disposable.

The use of complicated equipment for cleaning paint brushes, paint rollers and pads is well known in prior art. A typical paint brush and roller cleaning device is disclosed in U.S. Pat. No. 5,184,637 which was issued to Kenneth L. Kowis on Feb. 9, 1993. As noted in this patent, it consists of many parts and requires a substantial amount of time to set up to clean a brush or roller. It is a complicated and expensive device.

Another paint brush and paint roller cleaning device is disclosed in U.S. Pat. No. 5,185,938 which was issued to Hutt Heinz on Feb. 16, 1993. As noted in this patent it has three separate parts and requires additional power equipment. It is messy to use.

Whatever the merits, features and advantages of the above cited references, none of them achieves or fulfills the purposes or the simplicity, safety, efficiency or the reliability of the present invention.

SUMMARY OF THE INVENTION

The principal object of my invention is a simple, inexpensive solution to the problems mentioned above.

Another object is a tool that is safe to use and one that will never require parts or service.

Another object is to a simple designed, multiple use tool that cleans both regular paint brushes and sponge brushes, paint rollers and pad applicators.

Another object is to provide a durable tool, that is inexpensive and easily produced.

Another object is to provide a tool that stores right along with your paint brushes.

Another object is to provide a tool that is self-cleaning.

The above mentioned objects can be accomplished with my invention that cleans any size paint brushes, from the large 4" house painter's brush to an artist's brush. Also cleans sponge brushes, pad applicators and any size paint rollers. Which employs a scrub board for scrubbing sponge brushes and pad applicators, it lifts and separates the bristles of the paint brush and the nap of the paint roller for optimal cleaning.

The device also comprises a semicircular notch cutout which conforms to the shape of conventional paint rollers. It is used to scrape paint from the paint roller and comb the bristles of the paint brush back into shape after cleaning.

It is self cleaning, when the paint brush, roller or pad is clean, the scrubber is also clean.

The Paint Brush Scrubber can also be used for a variety of scrubbing and cleaning purposes.

BRIEF DISCRIPTION OF THE DRAWINGS

A paint brush cleaning device embodying features of my invention is illustrated in the accompanying drawings, forming part of this application, in which, FIG. 1 is a perspective view showing my paint brush scrubber's multiple ribs and the roller cleaning and brush combing cutout.

Figure 2:
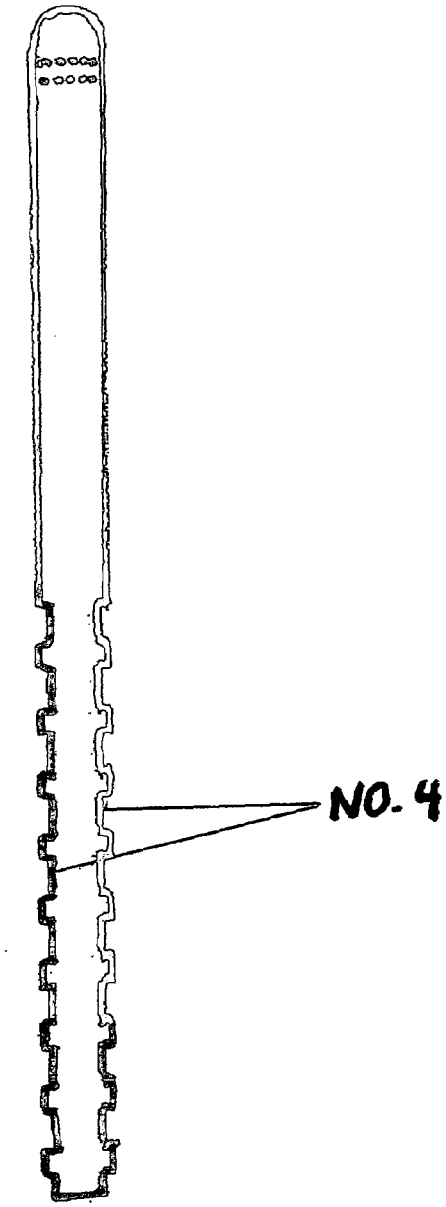

FIG. 2 is a side elevation view showing the two ribbed sides.

DETAILED DESCRIPTION OF THE INVENTION

As shown in FIG. 1 of the drawings, the Paint Brush Scrubber is a multiple use device, which can be made from a variety of materials, such as wood, plastic or metal. It is used for cleaning any size paint brushes, rollers and paint pad applicators. FIG. 2 shows that the device has an elongated body portion with two broadsides 4, for left and right hand use. Each broadside has a scrub board consisting of a multitude of rectangular notches 1 that extend from opposing planar side faces of the body portion for scrubbing, lifting and separating the bristles of the brush and the nap of the rollers and pad applicators, for optimal cleaning. The device also comprises a semicircular notched cutout 2, which conform to the shape of a conventional paint roller and is used to scrape paint from the rollers and comb paint brush bristles back into shape after cleaning. An elongated, reduced width handle extends from one end of the body portion and has a hole 3 in the free end thereof, so the tool can be stored with your paint brushes.

What I claim as my invention is:

1. The size can vary and can be made from a variety of materials wood, plastic, or metal.

* * * * *